US011171441B2

(12) United States Patent
Maeda et al.

(10) Patent No.: US 11,171,441 B2
(45) Date of Patent: Nov. 9, 2021

(54) SEAL MEMBER AND WATERPROOF CONNECTOR

(71) Applicants: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

(72) Inventors: Yusaku Maeda, Yokkaichi (JP); Takaaki Hamaguchi, Yokkaichi (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/815,542

(22) Filed: Mar. 11, 2020

(65) Prior Publication Data

US 2020/0303871 A1 Sep. 24, 2020

(30) Foreign Application Priority Data

Mar. 20, 2019 (JP) ..... JP2019-052110

(51) Int. Cl.
*H01R 13/52* (2006.01)
*H01R 43/00* (2006.01)

(52) U.S. Cl.
CPC ..... *H01R 13/5208* (2013.01); *H01R 13/5202* (2013.01); *H01R 13/5216* (2013.01); *H01R 13/52* (2013.01); *H01R 13/521* (2013.01); *H01R 13/5213* (2013.01); *H01R 13/5219* (2013.01); *H01R 43/005* (2013.01); *H01R 2201/26* (2013.01)

(58) Field of Classification Search
CPC ..... H01R 13/5202; H01R 13/521; H01R 13/5219; H01R 13/5208; H01R 2201/26; H01R 13/5216; H01R 43/005; H01R 13/52; H01R 13/5213
USPC ..... 439/271, 587
See application file for complete search history.

(56) References Cited

U.S. PATENT DOCUMENTS

2016/0197432 A1* 7/2016 Suzuki ..... H01R 13/506 439/587
2017/0145272 A1* 5/2017 Ooki ..... C08L 83/04

FOREIGN PATENT DOCUMENTS

JP 2018-159020 A 10/2018

* cited by examiner

*Primary Examiner* — Abdullah A Riyami
*Assistant Examiner* — Justin M Kratt
(74) *Attorney, Agent, or Firm* — Oliff PLC

(57) ABSTRACT

A seal member that includes an insertion hole into which a connector terminal is insertable, wherein, when a direction in which the connector terminal is to be inserted into the insertion hole is defined as an insertion axis: an inner diameter of a cross-section of the insertion hole orthogonal to the insertion axis at a position at which the inner diameter is the smallest is denoted as a minimum hole diameter D, an outer length of a cross-section of the connector terminal orthogonal to the insertion axis at a position at which the outer length is the largest is denoted as a maximum terminal outer length L, and the minimum hole diameter D and the maximum terminal outer length L satisfy a relationship $2.1 \leq L/D \leq 4.2$.

12 Claims, 6 Drawing Sheets

SEAL MEMBER AND WATERPROOF CONNECTOR

BACKGROUND

The present disclosure relates to a seal member and a waterproof connector.

There are cases where seal member is used in a connector used to connect an electrical component in a vehicle such as an automobile in order to keep water from entering the connector. The seal member is configured as a rubber molded member or the like, and has an insertion hole into which a connector terminal is insertable. A waterproof connector is configured in a state in which a terminal-equipped electrical wire in which the connector terminal is connected to a terminal end of the electrical wire is inserted into the insertion hole of the seal member housed in a connector housing.

In recent years, the number of electrical components provided in a vehicle such as an automobile has increased, and there is demand for a decrease in the size of the electrical components and integration of connection portions. Housing multiple connector terminals in one connector is effective in integrating the connection portions, and a seal member obtained by arranging multiple insertion holes in a shared seal member in the form of a matrix is used as the seal member used in a waterproof connector for housing multiple connector terminals. A seal member having multiple insertion holes and a waterproof connector provided with such a seal member are disclosed in JP 2018-159020A, for example.

SUMMARY

When a connector terminal is inserted into an insertion hole of a seal member used in a waterproof connector, there are cases where tears form in the seal member. Thun, there is a possibility that the seal member cannot sufficiently inhibit entering of water the connector. Entering of water may affect electrical connection realized by the connector terminal.

In particular, as disclosed in JP 2018-159020A, in the mode in which multiple insertion holes are formed in a shared seal member, if tears form in the seal member, entering of water will affect the entire seal member. In recent years, following integration of connection portions and a decrease in the size of connector terminals, the hole diameters of the insertion holes formed in the seal member have decreased. As a result of the diameters of the insertion holes being reduced, tears are more likely to form in the seal member.

In JP 2018-159020A, as a result of the seal member being constituted by thermosetting silicone rubber that has three units, each of which has a predetermined chemical structure, in the molecules thereof, tearing of the seal member is inhibited. Although it is possible to inhibit formation of tears in the seal member by experimenting with the material of the seal member, not only the material of the seal member but also the structure of the seal member, in particular, the shape and size of an insertion hole, will affect whether or not tears will form in the seal member. JP 2018-159020A focuses on the constituent material of the seal member and does not disclose the details regarding shape and size of the insertion hole.

An exemplary aspect of the disclosure provides through experimentation with the structure of an insertion hole of a seal member into which a connector terminal is to be inserted, a seal member that inhibits formation of tears when the connector terminal is inserted into the insertion hole and exhibits high water stoppability, and to provide a waterproof connector provided with such a seal member.

The seal member of the present disclosure includes an insertion hole into which a connector terminal is insertable, and when a direction in which the connector terminal is to be inserted into the insertion hole is defined as an insertion axis, an inner diameter of a cross-section of the insertion hole orthogonal to the insertion axis at a position at which the inner diameter is the smallest is denoted as a minimum hole diameter D, and an outer length of a cross-section of the connector terminal orthogonal to the insertion axis at a position at which the outer length is the largest is denoted as a maximum terminal outer length L, the minimum hole diameter D and the maximum terminal outer length L satisfy a relationship $2.1 \leq L/D \leq 4.2$.

In the seal member according to the present disclosure, the minimum hole diameter D of the insertion hole is defined to satisfy the relationship $2.1 \leq L/D \leq 4.2$ in the relationship with the maximum terminal outer length L of the connector terminal that is to be inserted into the insertion hole. As a result of the minimum hole diameter D being defined in such a manner, it is possible to inhibit formation of tears in the seal member when the connector terminal is inserted into the insertion hole. Also, it is possible to ensure high water stoppability of the seal member.

DETAILED DESCRIPTION OF EMBODIMENTS

Figure 1:
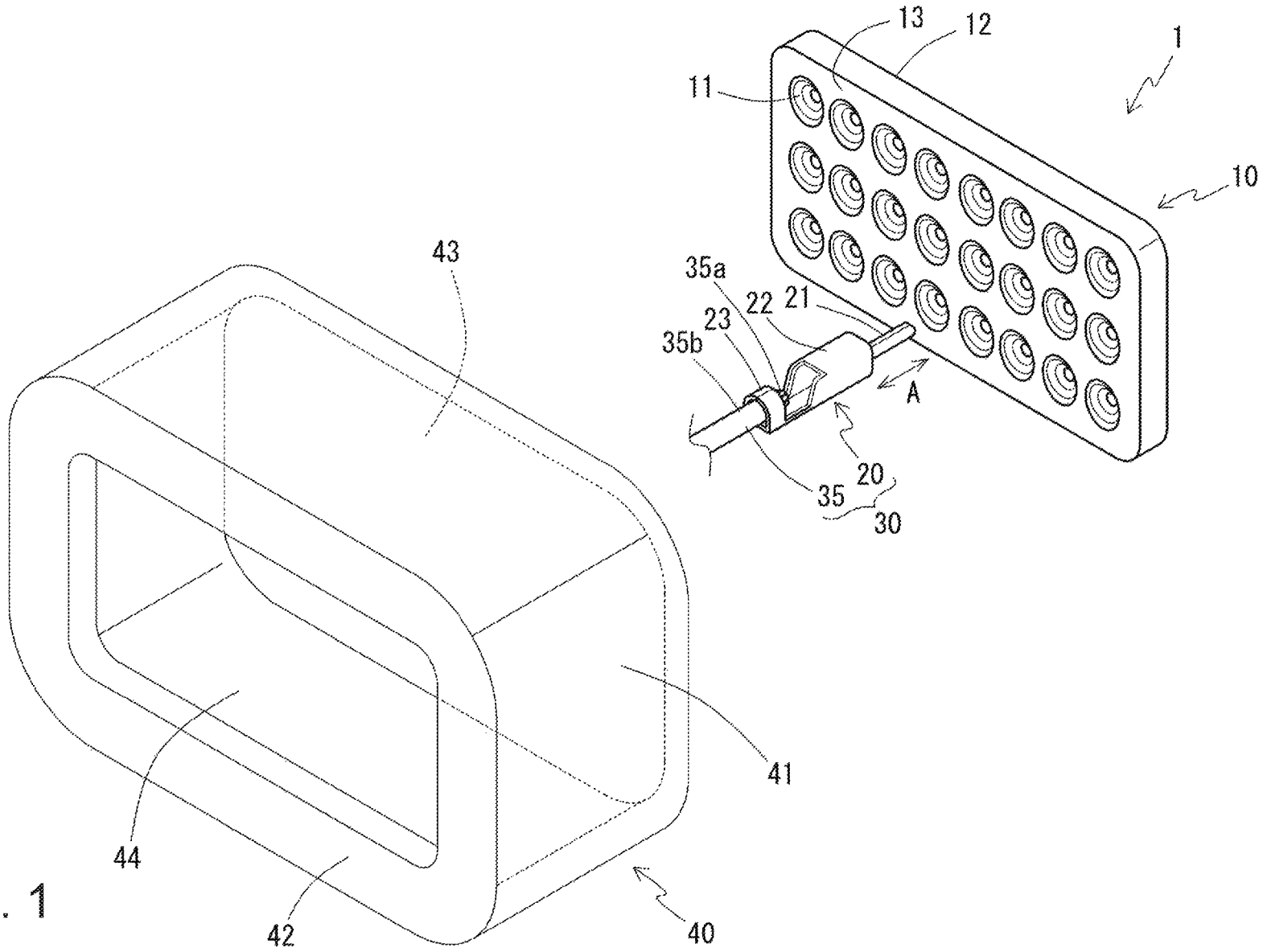
FIG. 1 is an exploded perspective view showing the configuration of a waterproof connector according to an embodiment of the present disclosure. A connector terminal and a connector housing are shown in FIG. 1 together with a seal member according to an embodiment of the present disclosure.

First, embodiments of the present disclosure will be described.

A seal member of the present disclosure includes an insertion hole into which a connector terminal is insertable, and when a direction in which the connector terminal is to be inserted into the insertion hole is defined as an insertion axis, an inner diameter of a cross-section of the insertion hole orthogonal to the insertion axis at a position at which the inner diameter is the smallest is denoted as a minimum hole diameter D, and an outer length of a cross-section of the connector terminal orthogonal to the insertion axis at a position at which the outer length is the largest is denoted as a maximum terminal outer length L, the minimum hole diameter D and the maximum terminal outer length L satisfy a relationship $2.1 \leq L/D \leq 4.2$.

In the seal member, the minimum hole diameter D of the insertion hole is defined in the relationship with the maximum terminal outer length L of the connector terminal that is to be inserted into the insertion hole. In the process of inserting the connector terminal into the insertion hole, tears are likely to form in the seal member, in particular, when a portion of the connector terminal whose cross-section has the maximum outer length passes through a portion of the insertion hole having the minimum inner diameter. Thus, it is possible to effectively inhibit the formation of tears in the seal member when the connector terminal is inserted into the insertion hole because the structure of the insertion hole is defined by the minimum hole diameter D of the insertion hole and the minimum hole diameter D is defined in the relationship with the maximum terminal outer length L of the connector terminal. In particular, as a result of $L/D \leq 4.2$ holding true, it is possible to effectively inhibit formation of tears in the seal member resulting from a connector terminal whose cross-section is excessively large with respect to the insertion hole being inserted into the insertion hole, and deterioration of the water stoppability caused by tears. In addition, as a result of $L/D \geq 2.1$ holding true, it is possible to inhibit water stoppability from being insufficient due to a cross-section of the connector terminal to be inserted being excessively small with respect to the size of the insertion hole.

Here, it is preferable that the seal member includes a plurality of the insertion holes. If the seal member includes a plurality of insertion holes, the diameter of each insertion hole is likely to be designed to be small, and thus tears are likely to form in the seal member and the water stoppability is likely to deteriorate, compared to the case where the seal member includes only one insertion hole. Also, tears that have formed in the seal member at portions of some insertion holes are likely to affect the entire seal member. However, as a result of the minimum hole diameter D of the insertion hole being set to satisfy the relationship $2.1 \leq L/D \leq 4.2$, it is possible to effectively inhibit formation of tears in the seal member and ensure high water stoppability even if the seal member includes a plurality of insertion holes.

It is preferable that the minimum hole diameter D is the diameter obtained when a cross-section of the insertion hole orthogonal to the insertion axis is approximated to a circle, and the maximum terminal outer length L is the length of a diagonal line obtained when a cross-section of the connector terminal orthogonal to the insertion axis is approximated to a quadrilateral. It is possible to effectively inhibit formation of tears in the seal member and ensure high water stoppability by defining the minimum hole diameter D by approximating a cross-section of the insertion hole to a circle, and defining the maximum terminal outer length L by approximating a cross-section of the connector terminal to a quadrilateral to set L/D to the above-described predetermined range in this manner. As a result of approximating a cross-section of the insertion hole and a cross-section of the connector terminal to simple shapes such as a circle and a quadrilateral, it is possible to easily design the insertion hole of the seal member and select the connector terminal to be inserted into the insertion hole.

It is preferable that, when an area of a cross-section of the insertion hole orthogonal to the insertion axis at a position at which the area is the smallest is denoted as a minimum hole area S, and an area of a cross-section of the connector terminal orthogonal to the insertion axis at a position at which the area is the largest is denoted as a maximum terminal area S', the minimum hole area S and the maximum terminal area S' satisfy a relationship $S'/S \geq 3.5$. As a result of defining the relationship between the minimum hole area S of the insertion hole and the maximum terminal area S' of the connector terminal, in addition to the relationship between the minimum hole diameter D of the insertion hole and the maximum terminal outer length L of the connector terminal, it is possible to further effectively inhibit water stoppability from being insufficient due to a cross-section of the connector terminal to be inserted being excessively small with respect to the size of the insertion hole.

It is preferable that, when an outer diameter of an electrical wire to be connected to the connector terminal is denoted as an electrical wire diameter ø, the electrical wire diameter ø and the minimum hole diameter D satisfy a relationship $ø/D \geq 1.5$. As a result, high water stopping performance can be easily ensured because an inner circumferential surface of the insertion hole and the surface of the electrical wire come into tight contact with each other when a terminal-equipped electrical wire in which a connector terminal is connected to a terminal end of the electrical wire is inserted into an insertion hole of the seal member from the connector terminal side, and the electrical wire is disposed in the insertion hole.

It is preferable that the seal member contains rubber or an elastomer. In particular, it is preferable that the seal member contains silicone rubber. As a result, the elasticity of rubber and an elastomer effectively inhibits formation of tears when the connector terminal is inserted into the insertion hole of the seal member.

It is preferable that the seal member has a Shore A hardness of 10 to 30 inclusive. As a result, the seal member has appropriate strength, and thus the state in which the constituent material of the seal member is in tight contact with the connector terminal and an electrical wire connected to the connector terminal can be easily maintained, and high water stoppability can be easily ensured. At the same time, appropriate flexibility of the seal member is ensured, and it is possible to effectively inhibit formation of tears when the connector terminal is inserted into the insertion hole.

A waterproof connector according to the present disclosure includes a seal member and a connector terminal that are as described above, and the connector terminal is inserted into the insertion hole of the seal member. As described above, with the waterproof connector, because the relationship between the minimum hole diameter D of the insertion hole of the seal member and the maximum terminal outer length L of the connector terminal is defined as $2.1 \leq L/D \leq 4.2$, it is possible to inhibit formation of tears in the seal member when the connector terminal is inserted into the insertion hole. Also, it is possible to inhibit insufficient water stoppability resulting from a cross-section of the connector terminal to be inserted being excessively small with respect to the size of the insertion hole. As a result, the waterproof connector has good water stopping performance.

Here, it is preferable that the connector terminal is connected to a terminal end of an electrical wire, and an inner circumferential surface of the insertion hole of the seal member is in surface contact with the electrical wire. The surface of the electrical wire can be in tight contact with the inner circumferential surface of the insertion hole without tears as a result of the formation of tears in the seal member being inhibited when the connector terminal connected to the terminal end of the electrical wire is inserted into the insertion hole of the seal member and passed through the insertion hole. As a result, high water stoppability is ensured between the seal member and the electrical wire.

It is preferable that the waterproof connector further includes a connector housing, and the seal member is housed in the connector housing. In this case, the seal member can function to keep water from entering the connector from the peripheries of the connector terminal and the electrical wire connected to the connector terminal, and also keep water from entering the connector from the outside of a wall surface of the connector housing.

It is preferable that the seal member is housed in the connector housing in a compressed state. As a result, it is possible to effectively keep water from entering the connector from the outside of the wall surface of the connector housing, and high water stopping performance can be achieved in the entire waterproof connector.

Hereinafter, a seal member and a waterproof connector according to an embodiment of the present disclosure will be described in detail with reference to the drawings. The seal member according to an embodiment of the present disclosure includes an insertion hole into which a connector terminal is to be inserted, and an inner diameter of the insertion hole is defined by the relationship with the outer length of the connector terminal. The waterproof connector according to an embodiment of the present disclosure is configured including such a seal member according to an embodiment of the present disclosure. Note that concepts indicating the shape and arrangement of members, such as parallel, perpendicular, orthogonal, rectangular, circular, and rectangular tubular, includes not only geometrically strict concepts but also deviations of an allowable degree as a connector and constituent members thereof in this specification.

Waterproof Connector

First, a waterproof connector according to an embodiment of the present disclosure will be described. FIG. 1 shows an exploded perspective view of a waterproof connector 1 according to an embodiment of the present disclosure.

The waterproof connector 1 includes a seal member 10 according to an embodiment of the present disclosure. The waterproof connector 1 further includes a terminal-equipped electrical wire 30 that has a connector terminal 20 (may simply be referred to as a "terminal" hereinafter), and a connector housing 40 (may simply be referred to as a "housing" hereinafter).

Although the seal member 10 will be described in detail later, the seal member 10 is configured as a plate-shaped member, and includes an insertion hole 11 into which the terminal 20 is insertable. Although the seal member 10 may be provided with only one insertion hole 11 or a plurality of insertion holes 11, a mode will be described in which a plurality of insertion holes 11 are arranged in the form of a matrix in a longitudinal direction and a latitudinal direction in the plate surface of the seal member 10. Although there is no particular limitation on the outer shape of the seal member 10, the seal member 10 is formed as a rectangular plate-shaped member with round corners here.

Terminals 20 are respectively inserted into the plurality of insertion holes 11 of the seal member 10. Although the terminals 20 are respectively inserted into all of the plurality of insertion holes 11 formed in the seal member 10, only one terminal 20 is shown in FIG. 1 for simplification.

With the waterproof connector 1, the terminals 20 inserted into the insertion holes 11 of the seal member 10 are connected to terminal ends of electrical wires 35 and form the mode of the terminal-equipped electrical wire 30. The terminals 20 each include, from the leading end thereof, an electrical connection portion 21, a tubular portion 22, and a crimping portion 23 integrally and continuously in the longitudinal direction. The electrical connection portion 21 is a portion that is electrically connected to a counterpart terminal (not shown), and the terminal 20 is formed as a male terminal having a flat plate tab-shaped electrical connection portion 21 in the mode shown in FIG. 1. The tubular portion 22 is a portion for linking the electrical connection portion 21 and the crimping portion 23, and is formed in a rectangular tubular shape in the mode shown in FIG. 1. The crimping portion 23 is a portion for fixedly crimping the electrical wire 35. The electrical wire 35 includes a conductor 35*a* and an insulating coating 35*b* for covering an outer circumferential surface of the conductor 35*a*. The insulating coating 35*b* is removed to expose the conductor 35*a* at the end portion of the electrical wire 35, and the conductor 35*a* is fixedly crimped to the crimping portion 23 of the terminal 20.

The terminal-equipped electrical wire 30 is inserted, from the leading end of the electrical connection portion 21 of the terminal 20, into the insertion hole 11 along an insertion axis A parallel to the thickness direction of the seal member 10, from a rear surface 13 side of the seal member 10 to a front surface 12 side. The terminal-equipped electrical wire 30 enters a state in which the entire terminal 20 in the longitudinal direction thereof has passed through the insertion hole 11. That is, with the waterproof connector 1, the terminal-equipped electrical wire 30 enters a state in which a portion of the electrical wire 35 connected to the terminal 20 is disposed in the insertion hole 11, and the outer circumferential surface of the electrical wire 35 is surrounded by the inner circumferential surface of the insertion hole 11.

With the waterproof connector 1, the seal member 10 is housed in the housing 40. The housing 40 is formed using a material that is harder than that of the seal member 10, and the housing 40 includes a rectangular tubular side wall surface 41, and a rear wall surface 42 provided at one end of the side wall surface 41. A wall surface is not provided at the other end of the side wall surface 41, and the other end is an opening 43. The rear wall surface 42 is preferably formed with a shape that is smaller than the plate surface of the seal member 10. Also, an inner portion of the rear wall surface 42 is provided with a window portion 44, as a region that is not covered by the constituent material of the housing 40. The position and size of the window portion 44 are set such that all of the insertion holes 11 are housed in the window portion 44 when the seal member 10 is housed in the housing 40 in tight contact with the rear wall surface 42.

With the waterproof connector 1, the seal member 10 is housed in the housing 40 from the opening 43, and the rear surface 13 of the seal member 10 comes into contact with the rear wall surface 42 of the housing 40. As a result of the rear wall surface 42 of the housing 40 being formed smaller than the outer shape of the seal member 10, the seal member 10 is housed in the housing 40 in a compressed state. The group of the insertion holes 11 provided in the seal member 10 face an external space via the window portion 40 of the housing 40.

Also, terminal-equipped electrical wires 30 are inserted into the insertion holes 11 of the seal member 10 housed in the housing 40. At this time, the terminals 20 constituting the terminal-equipped electrical wires 30 are inserted into the insertion holes 11 from the rear surface 13 of the seal member 10 via the window portion 44. The terminals 20 pass through the insertion holes 11, and as described above, the terminals 20 enter the state in which the electrical wires 35 are disposed in the insertion holes 11. Although not shown, the waterproof connector 1 further includes an inner housing that is disposed in the housing 40 and has terminal receiving chambers capable of receiving the terminals 20, and the terminals 20 that have passed through the insertion holes 11 of the seal member 10 are received by the terminal receiving chambers of the inner housing. The waterproof connector 1 is fitted to a counterpart connector (not shown) at the opening 43 of the housing 40, and the terminals 20 housed in the housing 40 are fitted to counterpart terminals at the electrical connection portions 21 thereof.

With the waterproof connector 1, the seal member 10 functions to keep water (or another liquid; the same applies to the following) from entering an inner portion of the space surrounded by the housing 40 from the outside. Specifically, as a result of the inner circumferential surfaces of the insertion holes 11 of the seal member 10 being in tight contact with the outer circumferential surfaces of the inserted electrical wires 35 in the form of the terminal-equipped electrical wires 30, it is possible to keep water from entering the inner portion of the housing 40 from the peripheries of the terminal-equipped electrical wires 30. In addition, as a result of the seal member 10 being in tight contact with the rear wall surface 42 of the housing 40 via the rear surface 13, water can be inhibited from entering from the outer side of the wall surface of the housing 40, and water can be inhibited from entering from the window portion 44 of the rear wall surface 42, in particular. As will be described in detail later, inhibition of the entering of water from the peripheries of the terminal-equipped electrical wires 30 is achieved by defining inner diameters of the insertion holes 11. Also, entering of water from the outer side of the wall surface of the housing 40 is effectively inhibited as a result of the seal member 10 being housed in the housing 40 in a compressed state.

Seal Member

Next, the seal member 10 according to an embodiment of the present disclosure will be described. As described above, the seal member 10 is configured as a plate-shaped member having the front surface 12 and the rear surface 13 that are parallel to each other, and the seal member 10 includes the insertion holes 11 extending between the front surface 12 and the rear surface 13 along the insertion axis A that is parallel to the thickness direction.

Constituent Material of Seal Member

A material that constitutes the seal member 10 is not particularly limited as long as the material can block permeation of water. Typically, the seal member 10 contains an organic polymer, and preferably, contains an organic polymer as the main component, that is, contains an organic polymer in an amount of 50 mass % or more with respect to the total mass of the seal member 10. The organic polymer preferably includes at least one of rubber and an elastomer. As a result, due to the elasticity of rubber and an elastomer, the seal member 10 comes into tight contact with the housing 40, and the inner circumferential surfaces of the insertion holes 11 come into tight contact with the outer circumferential surfaces of the terminal-equipped electrical wires 30, and thus the waterproof connector 1 is likely to exhibit high water stoppability. Also, when mechanical stress such as vibration is applied to the waterproof connector 1, the state in which the terminal-equipped electrical wires 30 are in tight contact with the housing 40 is maintained, and the state in which the waterproof connector 1 has high water stoppability is likely to be maintained.

It is particularly preferable to use silicone rubber as an organic polymer material constituting the seal member 10. Silicone rubber exhibits high water stoppability and elasticity, and has good mechanical strength, thermal stability, and chemical stability. It is preferable to use thermosetting addition reaction type silicone rubber as the silicone rubber. Addition reaction type silicone rubber contains alkenyl group-containing organopolysiloxane as the main component, and hydrosilyl group-containing organopolysiloxane as a curing agent, and molecular chains thereof are cross-linked by a platinum catalyst. Examples of the alkenyl group include a vinyl group, an allyl group, a butenyl group, and a pentenyl group. Organopolysiloxane has a polysiloxane chain (—Si—O—Si—O—) as the main chain, and an organic group on a Si atom of the main chain. Examples of the organic group of organopolysiloxane include a methyl group, an ethyl group, and a phenyl group. The same silicone rubber as in JP 2018-159020A can be suitably used, for example. Silicone rubber may contain an additive agent and filler as appropriate.

It is preferable that the constituent material of the seal member 10 has a Shore A hardness of 30 or less. When the Shore A hardness is 30 or less, flexibility of the seal member 10 is ensured, and the seal member 10 is likely to come in tight contact with the housing 40 and the terminal-equipped electrical wire 30. Also, when the terminal 20 is inserted into the insertion hole 11, tears are unlikely to form in the seal member 10 due to the flexibility of the seal member 10. Thus, the seal member 10 is likely to exhibit high water stoppability. On the other hand, it is preferable that the constituent material of the seal member 10 has a Shore A hardness of 10 or more. When the Shore A hardness is 10 or more, high water stoppability is likely to be ensured because appropriate strength of the seal member 10 is ensured, and the state in which the seal member 10 is in tight contact with the electrical wires 35 and the housing 40 can be easily maintained. Here, the Shore A hardness is a value at room temperature, and can be measured in conformity to JIS K 6253. Also, if a polymer material for constituting the seal member 10 is curable like the above-described addition reaction type silicone rubber, the Shore A hardness of the entire seal member 10 is evaluated in the cured state.

Structure of Insertion Hole

The insertion holes 11 extend along the insertion axis A between the front surface 12 and the rear surface 13 of the seal member 10. As longitudinal cross-sections (cross-sections parallel to the insertion axis A) of the insertion holes 11 being shown in FIG. 2A, the insertion holes 11 are not formed in a straight tubular shape having a flat inner circumferential surface, instead the inner circumferential surfaces of the insertion holes 11 have an uneven structure and the inner diameters of the insertion holes 11 change at positions located along the insertion axis A. Specifically, each insertion hole 11 has an opening portion 11*a* whose diameter gradually decreases inward in the thickness direction from the front surface 12 and the rear surface 13. Also, the insertion hole 11 has a lip portion 11*b* at an intermediate portion along the insertion axis A. The lip portion 11*b* is formed as a structure in which the constituent material of the seal member 10 protrudes in a ring shape inward in the radial direction of the insertion hole 11, and the inner diameter of the insertion hole 11 is small at a position at which the lip portion 11*b* is formed. In the mode shown in FIG. 2A, the insertion holes 11 are each provided with two lip portions 11*b* along the insertion axis A.

Figure 2A:
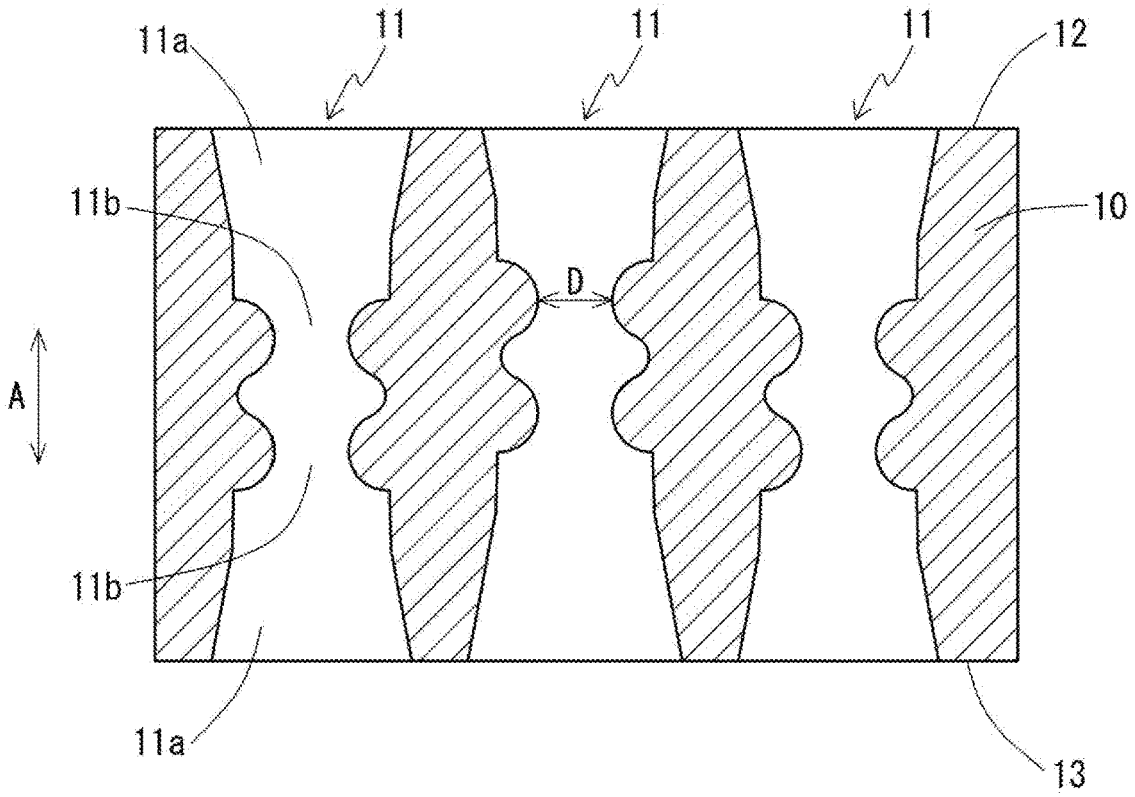
FIG. 2A is a cross-sectional view obtained by cutting the seal member along an insertion axis.
Figure 2B:
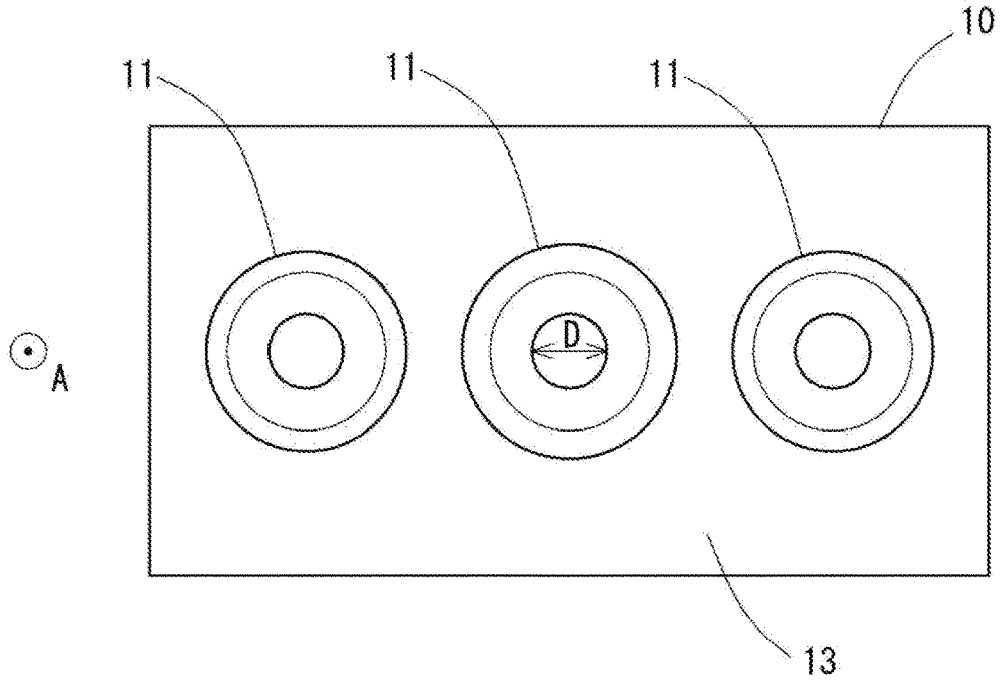
FIG. 2B is a plan view of the seal member viewed from a direction extending along an insertion axis A.

The inner diameter of the insertion hole 11 indicates the length of the shortest straight line out of straight lines that pass through the center of gravity of a region surrounded by an outer edge of the insertion hole 11 in cross-sections of the insertion hole 11 cut orthogonally to the insertion axis A at positions located along the insertion axis A. If a cross-section of the insertion hole 11 can be approximated to a circle, the inner diameter of the insertion hole 11 is the diameter of the circle. As described above, with the insertion hole 11, the inner diameter of the insertion hole 11 changes at positions located along the insertion axis A. Out of the inner diameters of the insertion hole 11 at these positions, the inner diameter thereof at a position at which the inner diameter is the smallest is regarded as a minimum hole diameter D of the insertion hole 11, and serves as a parameter for defining the structure of the insertion hole 11. In the mode shown in FIG. 2A, the inner diameter thereof is the smallest at positions of peak portions of lip portions 11*b* located at two positions, and as shown in FIG. 2A, the inner diameters thereof at the peak portions of these lip portions 11*b* are the minimum hole diameter D. As shown in FIG. 2B, when the inside of an insertion hole 11 is viewed from the outside along the insertion axis A, the diameter of the insertion hole 11 at a position at which the insertion hole 11 is the narrowest corresponds to the minimum hole diameter D. With the seal member 10 according to this embodiment, the minimum hole diameter D of the insertion hole 11 is defined by the relationship with the outer length of the terminal 20 to be inserted into the insertion hole 11.

Here, the outer length of the terminal 20 to be inserted into the insertion hole 11 will be described. The terminal 20 has portions whose cross-sectional shapes are different from each other along the insertion axis A, that is, the longitudinal axis. In cross-sections of the terminal 20 cut orthogonally to the insertion axis A at positions of the terminal 20 located along the insertion axis A, the length of a straight line having the maximum length, out of straight lines crossing the insertion hole 11 through the center of gravity of a region surrounded by an outer surface of the terminal 20, is defined as the outer length of the terminal 20 at this position. If the outer shape of a cross-section of the terminal 20 can be approximated to a quadrilateral such as a rectangle, the outer length of the terminal 20 refers to the length of a diagonal line of this quadrilateral. Out of the outer lengths of the terminal 20 at positions located along the insertion axis A, an outer length of the terminal 20 at a position at which the outer length thereof is the largest is regarded as a maximum terminal outer length L, and is used as a parameter for defining the minimum hole diameter D of the insertion hole 11 of the seal member 10. With the terminal 20 shown in FIG. 1, the outer length of the terminal 20 is the largest at an intermediate portion of the tubular portion 22 having a rectangular tubular shape, and as shown by a cross-section in FIG. 3, the outer length thereof at the intermediate portion of the tubular portion 22 is the maximum terminal outer length L. Here, the outer shape of a cross-section of the tubular portion 22 can be approximated to a rectangle, and the length of a diagonal line thereof is the maximum terminal outer length L.

With the seal member 10 according to this embodiment, the minimum hole diameter D of an insertion hole 11 satisfies the following expression (1) in the relationship with the maximum terminal outer length L of the terminal 20 to be inserted into the insertion hole 11.

$$2.1 \leq L/D \leq 4.2 \quad (1)$$

The larger the size ratio L/D is, which is the ratio between the maximum terminal outer length L of the terminal 20 and the minimum hole diameter D of the insertion hole 11, the smaller the diameter of a cross-section of the insertion hole 11 is with respect to the terminal 20 to be inserted into the insertion hole 11. When the terminal 20 having a large outer length is to be inserted into the insertion hole 11 having a small cross-sectional diameter, there is a possibility that the insertion hole 11 will be widened and tears will form in the constituent material of the seal member 10 from the inner circumferential surface of the insertion hole 11 at the time of insertion. If tears form on the inner circumferential surface of the insertion hole 11, there is a possibility that a gap will be formed at a portion where a tear has formed, between the inner circumferential surface of the insertion hole 11 and the electrical wire 35 disposed in the insertion hole 11. Also, there is a possibility that a portion where a tear has formed will serve as a water entering path. If such a phenomenon occurs, it will be difficult to maintain sufficient water stopping performance of the seal member 10 between the inner circumferential surface of the insertion hole 11 and the terminal-equipped electrical wire 30.

However, as shown in examples later, as a result of setting the size ratio L/D to 4.2 or less, it is possible to avoid a situation in which the terminal 20 having an excessively larger outer length than the cross-sectional diameter of the insertion hole 11 is inserted into the insertion hole 11 and the insertion hole 11 is excessively widened. As a result, when the terminal 20 is inserted into the insertion hole 11, tears are unlikely to form in the constituent material of the seal member 10 on the inner circumferential surface of the insertion hole 11. As a result, the inner circumferential surface of the insertion hole 11 free of tears is in contact with the outer circumferential surface of the electrical wire 35 in the state in which the terminal 20 has passed through the insertion hole 11 and the electrical wire 35 constituting the terminal-equipped electrical wire 30 is disposed in the insertion hole 11, and thus high adherence is obtained between the inner circumferential surface of the insertion hole 11 and the surface of the electrical wire 35. High water stopping performance of the seal member 10 is maintained due to high adherence and no tears, which will serve as water entering paths, being formed on the inner circumferential surface of the insertion hole 11. Thus, with the waterproof connector 1, it is possible to inhibit water from entering the inner portion of the housing 40 from a portion located between the insertion hole 11 and the terminal-equipped electrical wire 30 to a high degree. It is possible to further effectively increase the water stopping performance of the seal member 10 when the size ratio L/D is 4.0 or less, 3.5 or less, and 3.0 or less.

On the other hand, as the size ratio L/D that is the ratio between the maximum terminal outer length L of the terminal 20 and the minimum hole diameter D of the insertion hole 11 decreases, a terminal 20 having a smaller outer length with respect to a cross-section of the insertion hole 11 is inserted. With the terminal-equipped electrical wire 30, as the size of the terminal 20 decreases, an electrical wire having a smaller diameter is connected thereto as the electrical wire 35 that is compatible with the terminal 20. That is, the smaller the size ratio L/D is, the smaller the diameter of the electrical wire 35 disposed in the insertion hole 11 in the form of the terminal-equipped electrical wire 30 is. If the diameter of the electrical wire 35 to be disposed in the insertion hole 11 is excessively small with respect to the inner diameter of the insertion hole 11, the inner circumferential surface of the insertion hole 11 cannot come into tight contact with the outer circumferential surface of the electrical wire 35. As a result, a gap is likely to form between the inner circumferential surface of the insertion hole 11 and the electrical wire 35. Such a gap may serve as a water entering path, resulting in a decrease in the water stoppability of the seal member 10.

However, as shown in examples later, as a result of setting the size ratio L/D to 2.1 or more, it is possible to avoid a situation in which the terminal 20 to which an electrical wire 35 that is excessively smaller than the inner diameter of the insertion hole 11 is connected is inserted. As a result, the inner circumferential surface of the insertion hole 11 is in tight contact with the outer circumferential surface of the electrical wire 35 in the state in which the terminal 20 has passed through the insertion hole 11 and the electrical wire 35 constituting the terminal-equipped electrical wire 30 is disposed in the insertion hole 11, and thus it is possible to inhibit water from entering the inner portion of the housing 40 from a portion located between the insertion hole 11 and the electrical wire 35 to a high degree. In particular, as shown in the drawings, when a terminal having a tubular portion 22 formed in a rectangular tubular shape is used as the terminal 20, and when a small terminal having a maximum terminal outer length L of 3.5 mm or less, 3.0 mm or less, or 2.0 mm or less is used as the terminal 20, by causing the inner circumferential surface of the insertion hole 11 to come into tight contact with an electrical wire 35 that is usually applied as the electrical wire 35 connected to such a terminal 20, a strong water stoppability ensuring effect is achieved. Note that, when the seal member 10 is used in a state in which, even if the terminal-equipped electrical wire 30 is inserted into the insertion hole 11, the entire region of the terminal 20 in the longitudinal direction does not pass through the insertion hole 11, and the terminal 20 is disposed in the insertion hole 11, instead of the electrical wire 35, by setting L/D to 2.1 or more, the seal member 10 can inhibit entering of water from a portion located between the terminal 20 and the insertion hole 11, and exhibit high water stoppability.

As a result of setting the minimum hole diameter D of the insertion hole 11 in the seal member 10 such that the size ratio L/D satisfies the above-described expression (1) in this manner, it is possible to obtain a seal member 10 that has high water stoppability, inhibits deterioration of water stoppability resulting from tears forming in the seal member 10 when the terminal 20 is inserted into the insertion hole 11, and inhibits deterioration of water stoppability resulting from insufficient adherence between the inner circumferential surface of the insertion hole 11 and the terminal-equipped electrical wire 30. In particular, in a case where multiple insertion holes 11 are provided in a single seal member 10 and the terminals 20 are respectively inserted therein, if water stopping performance of some of the multiple insertion holes 11 deteriorates due to tears in the seal member 10 or insufficient adherence of the terminal 20, there is a possibility that the entire seal member 10 will be affected. Also, in recent years, the sizes of terminals have been reduced following integration of multiple terminals. Although the diameters of insertion holes provided in seal members have been reduced following integration and a decrease in the sizes of terminals, if the sizes of the insertion holes are not reduced as appropriate, sufficient water stopping performance may not be obtained due to tears in the seal member or insufficient adherence of the terminals.

In view of this, as a result of setting the minimum hole diameter D to satisfy the above-described expression (1), it is possible to design the seal member 10 to meet demand for integration of the terminals 20 and a decrease in the diameters of the insertion holes 11, thus contributing to reducing the space taken by the waterproof connector 1, while maintaining high water stopping performance of the insertion holes 11. Note that, if multiple insertion holes 11 are provided in the seal member 10, the diameters of the insertion holes 11 may be different from each other, in correspondence with insertion of terminals 20 having different sizes. In this case, it is sufficient to define the minimum hole diameter D of each insertion hole 11 to satisfy Expression (1) in the relationship with the maximum terminal outer length L of the terminal 20 to be inserted into the insertion hole 11.

The insertion hole 11 may have any cross-sectional shape or size as the insertion hole 11 overall, as long as the minimum hole diameter D satisfies the above-described expression (1). A terminal having any cross-sectional shape or size may also be used as the terminal 20 overall as long as the maximum terminal outer length L satisfies the above-described expression (1) in the relationship with the minimum hole diameter D. Also, the minimum hole diameter D of the insertion hole 11 and the maximum terminal outer length L of the terminal 20 are not absolute values, but the relationship therebetween is designated by the ratio therebetween, and the insertion hole 11 and the terminal 20 may have any size as absolute values.

A portion of the insertion hole 11 in which tears are most likely to form on the inner circumferential surface thereof is a portion having the smallest inner diameter (a narrow portion). Also, a situation in which tears are most likely to form in the narrow portion occurs when a portion of the terminal 20 that has the largest outer length (a large cross-sectional portion) passes through the narrow portion. Also, when a portion of the narrow portion of the insertion hole 11, the portion having the shortest distance between the opposing inner circumferential surfaces, is widened in a direction in which the large cross-sectional portion of the terminal 20 has the largest length (in a diagonal direction if the large cross-sectional portion is a quadrilateral), tears are most likely to form in the seal member 10. Thus, if the minimum hole diameter D of the insertion hole 11 is defined using the ratio to the maximum terminal outer length L of the terminal 20 to satisfy $L/D \leq 4.2$, it is possible to exhibit the effect of inhibiting tears in the seal member 10 even if the narrow portion of the insertion hole 11 and the large cross-sectional portion of the terminal 20 have any specific shape, or even if a portion of the insertion hole 11 other than the narrow portion and a portion of the connection terminal 20 other than the large cross-sectional portion have any shape and size.

On the other hand, the narrow portion of the insertion hole 11 that has the smallest inner diameter exhibits the highest adherence to the terminal-equipped electrical wire 30 disposed inside the insertion hole 11. Also, with the terminal-equipped electrical wire 30, the outer length of a cross-section of each portion of the terminal 20 and the outer diameter of the electrical wire 35 that is compatible to the terminal 20 usually have a positive correlation with the maximum terminal outer length L of the terminal 20. Thus, by defining the minimum hole diameter D of the insertion hole 11 using the ratio to the maximum terminal outer length L of the terminal 20 to satisfy $L/D \geq 2.1$, it is possible to cause the inner circumferential surface of the insertion hole 11 to be in tight contact with the surface of the terminal-equipped electrical wire 30 that has been inserted into the insertion hole 11, and to ensure high water stoppability.

As a result of designing the structure of the insertion hole 11 and selecting the terminal 20 to be inserted into the insertion hole 11 using, as indexes, parameters that can be easily set and measured, such as the minimum hole diameter D of the insertion hole 11 and the maximum terminal outer length L of the terminal 20, it is possible to easily design and manufacture a seal member 10 and a waterproof connector 1 exhibiting high water stoppability. Also, regardless of specific shapes or sizes of the insertion holes 11 and the terminals 20, as a result of measuring the minimum hole diameters D of the insertion holes 11 and the maximum terminal outer lengths L of the terminals 20, and evaluating the size ratio L/D, which is the ratio of these values, it is possible to easily determine whether or not a combination of an insertion hole 11 and a terminal 20 that are focused on can ensure sufficient water stoppability. In particular, if a cross-section of the insertion hole 11 can be approximated to a circle, the minimum hole diameter D can be set as the diameter of the circle, and if a cross-section of the terminal 20 can be approximated to a quadrilateral, the maximum terminal outer length L can be set as the length of a diagonal line of the quadrilateral. If such approximations can be applied, it is possible to design the insertion hole 11, select the terminal 20, and determine whether or not sufficient water stoppability can be ensured, with even more ease.

Although the minimum hole diameter D, which is the minimum value of the inner diameter of the insertion hole 11, is used as the parameter for defining the structure of the insertion hole 11 and the maximum terminal outer length L, which is the maximum value of the outer length, is used as the parameter for defining the structure of the terminal 20, it is conceivable to ensure water stoppability of the seal member 10 by defining the structures of the insertion hole 11 and the terminal 20 using other parameters. It is conceivable to use a cross-sectional area of the insertion hole 11 as the parameter for defining the structure of the insertion hole 11, and use a cross-sectional area of the terminal 20 as the parameter for defining the structure of the terminal 20, for example. Specifically, a mode is conceivable in which the area of a cross-section of the insertion hole 11 at a position at which the cross-sectional area orthogonal to the insertion axis A is the smallest is regarded as a minimum hole area S, and the area of a cross-section of the terminal 20 at a position at which the cross-sectional area orthogonal to the insertion axis A is the largest is regarded as a maximum terminal area S', and the structures of the insertion hole 11 and the terminal 20 are defined using an area ratio S'/S. Note that the area of the insertion hole 11 is evaluated as the area of a region surrounded by an outer edge of the insertion hole, and the area of the terminal 20 is evaluated as the area of a region surrounded by the outer surface of the terminal 20.

The smaller the area ratio S'/S is, the larger a cross-section of the insertion hole 11 is with respect to a cross-section of the terminal 20. As described in the examples later, by setting the lower limit of the area ratio S'/S, it is possible to inhibit adherence of the inner circumferential surface of the insertion hole 11 to the surface of the terminal-equipped electrical wire 30 from becoming insufficient due to a cross-section of the insertion hole 11 being excessively large with respect to a cross-section of the terminal 20, and thus these parameters can be used as indexes for ensuring water stoppability. Specifically, it is possible to ensure high water stoppability by setting the area ratio S'/S as in the following expression (2).

$$S'/S \geq 3.5 \quad (2)$$

On the other hand, even if the upper limit of the area ratio S'/S is set, a cross-section of the insertion hole 11 is excessively small with respect to a cross-section of the terminal 20, and thus these parameters cannot be used as accurate indexes for inhibiting a phenomenon in which tears form in the seal member 10 from the inner circumferential surface of the insertion hole 11 when the terminal 20 is inserted into the insertion hole 11. That is, as shown in the examples later, it is difficult to set, as appropriate, using a shared upper limit, the range of the area ratio S'/S that can inhibit tears in the seal member 10 and ensure sufficient water stoppability if the terminal 20 to be used is changed. The reasons are as follows. Even if the terminals 20 may have the same maximum terminal area S', the terminals 20 have various cross-sectional shapes that provide the maximum terminal area S'. If a cross-sectional shape thereof is a rectangle, for example, a square and an elongated rectangle may have a rectangular cross-section. Out of such various cross-sectional shapes, the shape that is most likely to form tears on the inner circumferential surface of the insertion hole 11 when the terminal 20 is inserted into the insertion hole 11 is highly anisotropic and has a size that is long in any one direction, such as an elongated rectangle. In such a situation, even if attempts are made to set the upper limit of the area ratio S'/S considering a terminal 20 only in terms of the maximum terminal area S' without considering the cross-sectional shape of the terminal 20, whether or not tears will form in the seal member 10 when a given terminal 20 is inserted into an insertion hole 11 cannot be accurately evaluated.

Although the area ratio S'/S is not necessarily appropriate as an index for inhibiting deterioration of water stoppability resulting from tears in the seal member 10, it is possible to use, as an index for ensuring water stoppability through tight contact with the terminal-equipped electrical wire 30, the area ratio S'/S in a region where a cross-section of the insertion hole 11 is sufficiently large and tears do not form in the seal member 10. It is sufficient to set the minimum hole diameter D of the insertion hole 11 to satisfy the above-described expression (1) in the relationship with the maximum terminal outer length L of the terminal 20, and then set the minimum hole area S of the insertion hole 11 to satisfy the above-described expression (2) in the relationship with the maximum terminal area S' of the terminal 20, for example. As a result of using the indexes of the expression (1) and the expression (2) in combination in such a manner, it is more easy to obtain the effect of improving water stoppability through adherence between the inner circumferential surface of the insertion hole 11 and the surface of the terminal-equipped electrical wire 30 disposed in the insertion hole 11 while avoiding tears in the seal member 10 when inserting the terminal 20 into the insertion hole 11.

Also, an example of another parameter of the terminal-equipped electrical wire 30 is the outer diameter of the electrical wire 35, that is, an electrical wire diameter ø, the other parameter being used as a reference for defining the shape of the insertion hole 11. The electrical wire diameter ø is evaluated as the diameter obtained when the outer circumferential surface of the insulating coating **35*b* in a state in which the outer circumferential surface of the conductor 35*a* is covered by the insulating coating 35*b* is approximated to a circle in a cross-section orthogonal to the axial direction of the electrical wire 35**.

The electrical wire diameter ø of the electrical wire 35 is usually smaller than the maximum terminal outer length L of the terminal 20, and the electrical wire diameter ø of the electrical wire 35 is unlikely to affect whether or not tears will form in the seal member 10 when the terminal 20 is inserted into the insertion hole 11. However, with the terminal-equipped electrical wire 30, the electrical wire 35 is disposed in the insertion hole 11 after the terminal 20 has passed through the insertion hole 11, and thus the electrical wire diameter ø of the electrical wire 35 may affect the degree of water stoppability resulting from adherence between the terminal-equipped electrical wire 30 and the inner circumferential surface of the insertion hole 11. The smaller the minimum hole diameter D of the insertion hole 11 is with respect to the electrical wire diameter ø of the electrical wire 35, the higher the adherence of the inner circumferential surface of the insertion hole 11 to the outer periphery of the electrical wire 35 is, and high water stopping performance can be obtained at a position between the insertion hole 11 and the terminal-equipped electrical wire 30.

Specifically, as will be shown in the examples later, it is sufficient to define a diameter ratio ø/D based on the minimum hole diameter D of the insertion hole 11 and the electrical wire diameter ø of the electrical wire 35, and set the diameter ratio ø/D to satisfy the following equation (3).

$$ø/D \geq 1.5 \quad (3)$$

It is sufficient to set the minimum hole diameter D of the insertion hole 11 to satisfy the above-described expression (1) in the relationship with the maximum terminal outer length L of the terminal 20, and, as needed, to set the minimum hole area S of the insertion hole 11 to satisfy the above-described expression (2) in the relationship with the maximum terminal area S' of the terminal 20, and then, to set the minimum hole diameter D of the insertion hole 11 to satisfy the above-described expression (3) in the relationship with the electrical wire diameter ø of the electrical wire 35, for example. As a result of using the index of the expression (3) in combination with the index of the expression (1) (and the expression (2)) in such a manner, it is more easy to obtain the effect of improving water stoppability through adherence between the inner circumferential surface of the insertion hole 11 and the electrical wire 35 disposed in the insertion hole 11 while avoiding tears in the seal member 10 when inserting the terminal 20 into the insertion hole 11. In particular, with the terminal-equipped electrical wire 30, if a difference between an electrical wire diameter that is usually conceivable from the compatibility to the terminal 20 and an electrical wire diameter ø of the electrical wire 35 that is actually used is large, by defining the diameter ratio using the above-described expression (3), it is easy to increase adherence between the outer periphery of the electrical wire 35 and the inner circumferential surface of the insertion hole 11 in a state in which the electrical wire 35 is disposed in the insertion hole 11, and obtain sufficient water stoppability.

Also, it is preferable that surface pressure applied from the inner circumferential surface of the insertion hole 11 to the terminal-equipped electrical wire 30 in a state in which the terminal-equipped electrical wire 30 is inserted into the insertion hole 11 is 200 kPa or more. As a result of having such surface pressure, the inner circumferential surface of the insertion hole 11 is in tight contact with the terminal-equipped electrical wire 30, thus exhibiting high water stopping performance. Surface pressure can be controlled using the electrical wire diameter ø, a constituent material of the seal member 10, and the like, in addition to the relationship between the minimum hole diameter D of the insertion hole 11 and the maximum terminal outer length L of the terminal 20. Surface pressure can be calculated through analysis using Computer Aided Engineering (CAE), for example.

EXAMPLES

Examples will be described hereinafter. Here, the influence of the relationship between an insertion hole of a seal member and a terminal-equipped electrical wire on water stoppability of the seal member was examined. Note that the present disclosure is not limited by these examples.

Preparation of Samples

Silicone rubber was molded in a plate shape having a thickness of 5 mm to form a seal member. As shown in FIGS. 2A and 2B, insertion holes having lip portions were formed in the seal member, in the form of an 8×1 matrix. Silicone rubber of three levels of hardness, namely, silicone rubber having a Shore A hardness of 10, 20, and 30, was used. Here, the Shore A hardness is a value obtained through measurement at room temperature in conformity to JIS K 6253 after silicone rubber is cured. The hardness of silicone rubber was adjusted by adjusting the amount of added filler.

A plurality of seal members in which narrow portions of the insertion holes had different diameters were prepared using silicone rubber of each hardness level. In an insertion hole, a peak portion of a lip portion was a narrow portion whose cross-section had the smallest inner diameter and that had the smallest cross-sectional area. The cross-sectional shape of the narrow portion was a circle. With regard to the prepared seal members 1 to 10, the minimum hole diameters D and the minimum hole areas S of the insertion holes measured in cross-sections of the narrow portions are summarized in Table 1 below, together with adjacent thicknesses, which were the maximum values of the thicknesses of silicone rubber between adjacent insertion holes.

TABLE 1

| | Seal Member Number | | | | | | | | | |
|---|---|---|---|---|---|---|---|---|---|---|
| | 1 | 2 | 3 | 4 | 5 | 6 | 7 | 8 | 9 | 10 |
| Min. Hole Diameter D (mm) | 0.65 | 0.70 | 0.75 | 0.80 | 0.85 | 0.90 | 0.95 | 1.20 | 1.65 | 2.00 |
| Min. Hole Area S ($mm^2$) | 0.33 | 0.38 | 0.44 | 0.50 | 0.57 | 0.64 | 0.71 | 1.13 | 2.14 | 3.14 |
| Adjacent Thickness (mm) | 1.95 | 1.90 | 1.85 | 1.80 | 1.75 | 1.70 | 1.65 | 1.40 | 0.95 | 0.60 |

Figure 3:
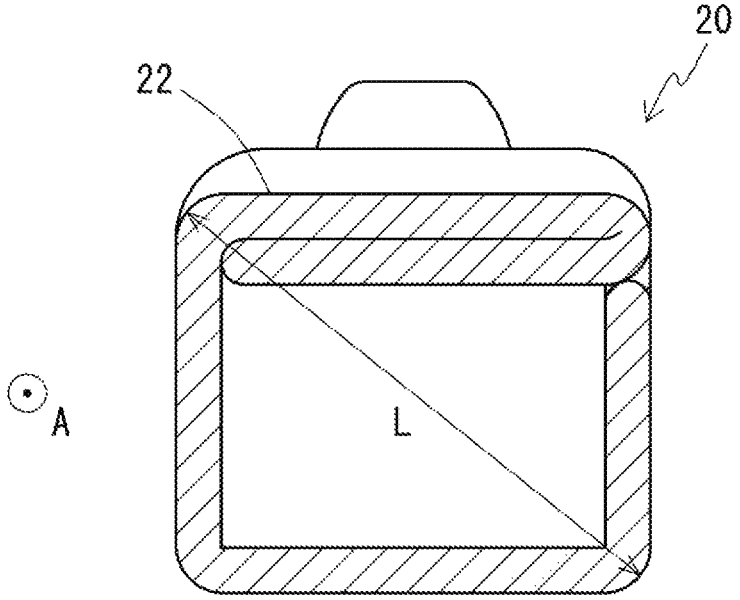
FIG. 3 is a cross-sectional view obtained by cutting a tubular portion of the connector terminal perpendicular to the insertion axis.

As shown in FIGS. 1 and 3, a tin-plated copper alloy plate was folded to form, as a terminal, a male terminal including, as a single member, a tab-shaped electrical connection portion, a tubular portion, and a crimping portion. As shown in FIG. 3, the tubular portion was formed in a rectangular tubular shape having a rectangular cross-section. Terminals 1 to 3 having different sizes were prepared. Intermediate portions of the tubular portions of all the terminals were large cross-sectional portions, each of which had the largest cross-sectional area and the longest diagonal line. The size and area of each terminal measured in a cross-section of the large cross-sectional portion are shown in Table 2 below. Here, the width and the height indicate the length of each side obtained when a cross-section was approximated to a rectangle, and an aspect ratio indicates a value obtained by dividing the width by the height. Also, the maximum terminal outer length L corresponds to the length of a diagonal line in a cross-section, and the maximum terminal area S' corresponds to the area of a region surrounded by the surface of a terminal.

TABLE 2

| Terminal Number | 1 | 2 | 3 |
|---|---|---|---|
| Width (mm) | 1.56 | 1.64 | 2.29 |
| Height (mm) | 1.56 | 2.20 | 2.47 |
| Aspect Ratio | 1.00 | 0.75 | 0.93 |
| Max. Terminal Outer Size L(mm) | 1.90 | 2.75 | 3.15 |
| Max. Terminal Area S'($mm^2$) | 2.43 | 3.60 | 5.64 |

Also, electrical wires with insulating coatings on outer circumferential surfaces of conductors thereof were prepared. Electrical wires of three electrical wire diameters ø shown in Table 3 below were prepared. Also, each electrical wire was connected to a terminal by removing the insulating coating of an end portion of the electrical wire and crimping a portion at which a conductor was exposed, with a crimping portion of the terminal. A terminal-equipped electrical wire was obtained in this manner. An electrical wire 1 was connected to the terminal 1, an electrical wire 2 was connected to the terminal 2, and an electrical wire 3 was connected to the terminal 3.

TABLE 3

| Electrical Wire Number | 1 | 2 | 3 |
|---|---|---|---|
| Electrical Wire Outer Diameter ø (mm) | 1.35 | 1.75 | 2.05 |

Evaluation Method

The terminals were respectively inserted into the insertion holes of the seal members prepared as described above, and whether or not tears formed was checked, and water stoppability was evaluated in a leak test.

First, the terminals were inserted into and passed through all of the insertion holes provided in the seal member. After the terminals were removed, the inner circumferential surfaces of the insertion holes were visually observed, and whether or not tears had formed in the constituent material of the seal member was determined. A case where no tears were observed in any one of the insertion holes formed in one seal member was evaluated as (A) having no tears, and a case where tears were observed in any one of the insertion holes was evaluated as (B) having tears.

Also, a waterproof connector was produced using a new seal member free of tears. That is, as shown in FIG. 1, the seal member was housed in a housing to be pressed against a rear wall surface thereof. Also, terminal-equipped electrical wires were respectively inserted into the insertion holes of the seal member. At this time, the terminals were caused to pass through the insertion holes, achieving the state in which the electrical wires were disposed in the insertion holes. The waterproof connector in this state was attached to one end of a tube to prepare a test piece. Then, a portion of the waterproof connector of the test piece was immersed in water, and air was introduced, from the other end of the tube at a pressure of 200 kPa. Whether air bubbles were generated in the waterproof connector immersed in water from a portion located between the seal member and the terminal-equipped electrical wires was visually observed while air was introduced. A case where no air bubbles were generated was determined as (A) having sufficient water stoppability, and a case where air bubbles were generated was determined as (B) having insufficient water stoppability. Note that it was separately confirmed that no air bubbles were generated between the housing and the seal member, and between the tube and the waterproof connector.

Results of Evaluation

Results of evaluation regarding tears and water stoppability of the seal members are shown in Tables 4 to 6, together with the size ratios L/D, the area ratios S'/S, and the diameter ratios ø/D. The results regarding the terminal 1 are shown in Table 4, the results regarding the terminal 2 are shown in Table 5, and the results regarding the terminal 3 are shown in Table 6. Results of evaluation made on the seal members whose insertion holes had different sizes and that were produced using materials of three levels of hardness.

TABLE 4

| Terminal-Equipped Electrical Wire | | Terminal 1: L = 1.90 mm, S' = 2.43 $mm^2$ + Electrical Wire 1: ø = 1.35 mm | | | | | | | |
|---|---|---|---|---|---|---|---|---|---|
| Min. Hole Diameter D (mm) | | 1.20 | 0.95 | 0.90 | 0.85 | 0.80 | 0.75 | 0.70 | 0.65 |
| Min. Hole Area S ($mm^2$) | | 1.13 | 0.71 | 0.64 | 0.57 | 0.50 | 0.44 | 0.38 | 0.33 |
| Size Ratio L/D | | 1.58 | 2.00 | 2.11 | 2.24 | 2.38 | 2.53 | 2.71 | 2.92 |
| Area Ratio S'/S | | 2.15 | 3.43 | 3.82 | 4.28 | 4.83 | 5.50 | 6.31 | 7.33 |
| Diameter Ratio ø/D | | 1.13 | 1.42 | 1.50 | 1.59 | 1.69 | 1.80 | 1.93 | 2.08 |
| Hardness A30 | Tears | A | A | A | A | A | A | A | A |
| | Water Stoppability | B | A | A | A | A | A | A | A |
| Hardness A20 | Tears | A | A | A | A | A | A | A | A |
| | Water Stoppability | B | A | A | A | A | A | A | A |
| Hardness A10 | Tears | A | A | A | A | A | A | A | A |
| | Water Stoppability | B | B | A | A | A | A | A | A |

TABLE 5

| Terminal-Equipped Electrical Wire | | Terminal 2: L = 2.75 mm, S' = 3.60 mm$^2$ + Electrical Wire 2: ø = 1.75 mm | | | | | | | |
|---|---|---|---|---|---|---|---|---|---|
| Min. Hole Diameter D (mm) | | 1.65 | 0.95 | 0.90 | 0.85 | 0.80 | 0.75 | 0.70 | 0.65 |
| Min. Hole Area S (mm$^2$) | | 2.14 | 0.71 | 0.64 | 0.57 | 0.50 | 0.44 | 0.38 | 0.33 |
| Size Ratio L/D | | 1.67 | 2.89 | 3.06 | 3.24 | 3.44 | 3.67 | 3.93 | 4.23 |
| Area Ratio S'/S | | 1.68 | 5.08 | 5.66 | 6.34 | 7.16 | 8.15 | 9.35 | 10.9 |
| Diameter Ratio ø/D | | 1.06 | 1.84 | 1.94 | 2.06 | 2.19 | 2.33 | 2.50 | 2.69 |
| Hardness | Tears | A | A | A | A | A | A | A | B |
| A30 | Water Stoppability | B | A | A | A | A | A | A | B |
| Hardness | Tears | A | A | A | A | A | A | A | A |
| A20 | Water Stoppability | B | A | A | A | A | A | A | A |
| Hardness | Tears | A | A | A | A | A | A | A | A |
| A10 | Water Stoppability | B | A | A | A | A | A | A | A |

TABLE 6

| Terminal-Equipped Electrical Wire | | Terminal 3: L = 3.15 mm, S' = 5.64 mm$^2$ + Electrical Wire 3: ø = 2.05 mm | | | | | | | |
|---|---|---|---|---|---|---|---|---|---|
| Min. Hole Diameter D (mm) | | 2.00 | 0.95 | 0.90 | 0.85 | 0.80 | 0.75 | 0.70 | 0.65 |
| Min. Hole Area S (mm$^2$) | | 3.14 | 0.71 | 0.64 | 0.57 | 0.50 | 0.44 | 0.38 | 0.33 |
| Size Ratio L/D | | 1.58 | 3.32 | 3.50 | 3.71 | 3.94 | 4.20 | 4.50 | 4.85 |
| Area Ratio S'/S | | 1.80 | 7.96 | 8.87 | 9.94 | 11.2 | 12.8 | 14.7 | 17.0 |
| Diameter Ratio ø/D | | 1.03 | 2.16 | 2.28 | 2.41 | 2.56 | 2.73 | 2.93 | 3.15 |
| Hardness | Tears | A | A | A | A | A | A | B | B |
| A30 | Water Stoppability | B | A | A | A | A | A | B | B |
| Hardness | Tears | A | A | A | A | A | A | B | B |
| A20 | Water Stoppability | B | A | A | A | A | A | B | B |
| Tears | A | A | A | A | A | A | B | B | |
| Hardness | Water Stoppability | B | A | A | A | A | A | B | B |

(1) Relationship Between Size Ratio L/D and Water Stopping Performance

Figure 4:
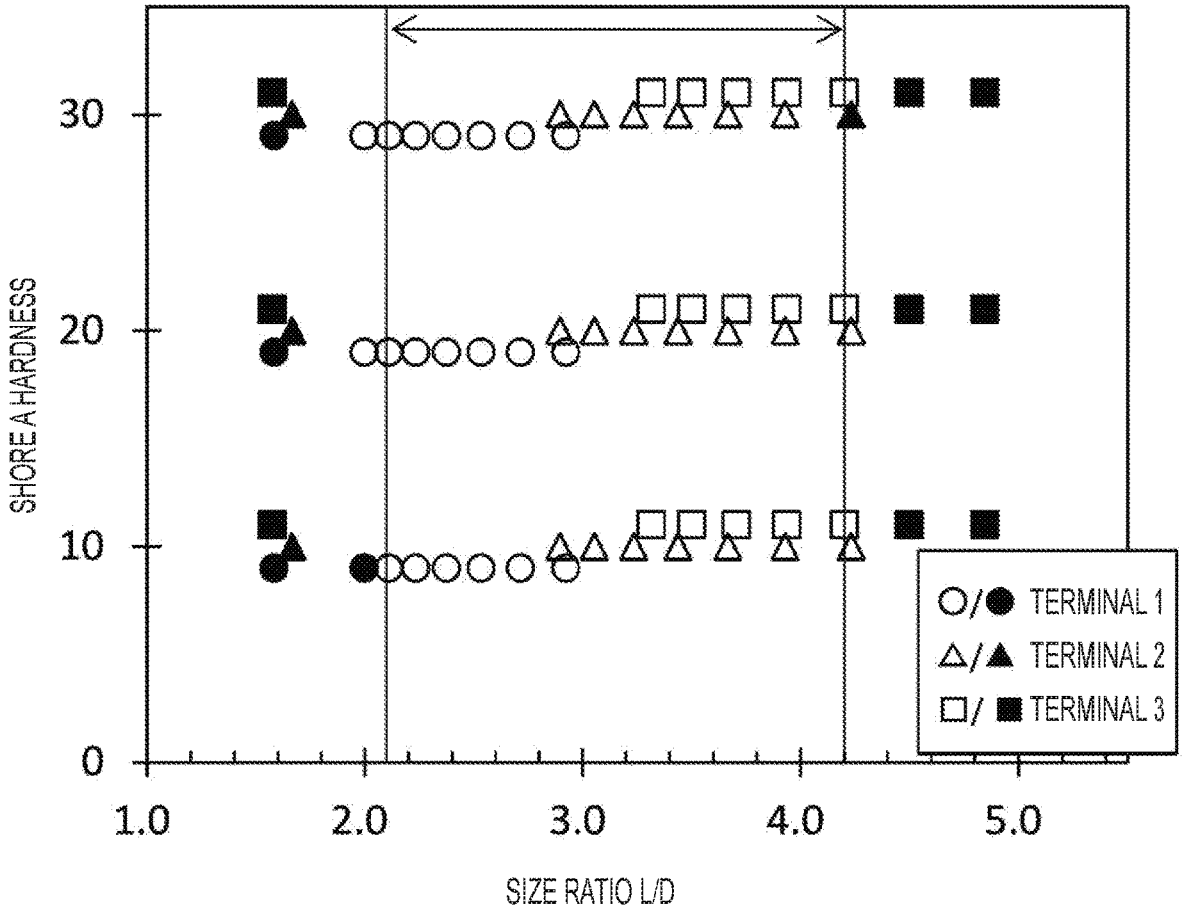
FIG. 4 is a diagram showing the relationship between a size ratio L/D and water stoppability with regard to examples.

FIG. 4 shows relationships between the results of evaluation of the size ratio L/D and water stopping performance. In FIG. 4, the horizontal axis indicates the size ratio L/D, and the vertical axis indicates the Shore A hardness. Data points at which water stoppability was sufficient are indicated using white marks, and data points at which water stoppability was insufficient are indicated using black marks. Also, the size of a terminal is indicated using a type of mark, and the terminal 1 is indicated using a circular mark, the terminal 2 is indicated using a triangular mark, and the terminal 3 is indicated using a rectangular mark. To facilitate understanding, the hardness of the vertical axis indicates hardness with the hardness being shifted by −1 for the terminal 1, and the hardness being shifted by +1 for the terminal 3.

In Tables 4 to 6 and FIG. 4, when the results of evaluation of water stoppability evaluated in a leak test are looked at, with regard to many hardnesses and terminal types, water stoppability was evaluated as insufficient (B) in a region having a small size ratio L/D and a region having a large size ratio L/D. The result that tears formed (B) was obtained in evaluation of tears in a region having a large size ratio L/D, out of regions at these two ends. This means that tears of the seal members formed on the inner circumferential surfaces of the insertion holes decreased water stoppability in a region having a large size ratio L/D. That is, it is interpreted that a terminal having an excessively large maximum terminal outer length L with respect to the minimum hole diameter D was inserted into an insertion hole, and tears formed in the seal member at the time of insertion, and thus water entered from positions of the tears, as a result of which water stoppability had decreased.

On the other hand, in a region having a small size ratio L/D, tears did not form in the seal member (A), but water stopping performance was insufficient (B). Based on these results, it is interpreted that the inner circumferential surfaces of the insertion holes were not in tight contact with the inserted terminal-equipped electrical wires because the maximum terminal outer lengths L were excessively small with respect to the minimum hole diameters D of the insertion holes, and water entered from a gap formed between the inner circumferential surfaces of the insertion holes and the terminal-equipped electrical wires, and water stoppability decreased.

In this manner, although water stoppability was insufficient in a region having a small size ratio L/D and a region having a large size ratio L/D due to formation of tears in the seal members or insufficient adherence between the inner circumferential surfaces of the insertion holes and the terminal-equipped electrical wires, no tears formed in the seal members (A) and water stoppability was sufficient (A) in a region located between these regions. As shown in FIG. 4 using a solid line, regarding all of the terminals 1 to 3 having a Shore A hardness of 10 to 30, sufficient water stoppability was obtained in a region where $2.1 \leq L/D \leq 4.2$ held true.

As shown in Table 1, the terminals 1 to 3 had different widths and heights in cross-sections of the large cross-sectional portions, and had different aspect ratios. However, as a result of using, as the index, the size ratio L/D, which is the ratio between the maximum terminal outer length L, that is, the length of a diagonal line of a large cross-sectional portion, and the minimum hole diameter D of an insertion hole, water stopping performance of a seal member was ensured, regardless of the size or an aspect ratio of a cross-section of a terminal. That is, it is possible to avoid tears in the seal member, and to identify combinations of seal members and terminals that exhibit high water stopping performance due to the terminal-equipped electrical wire being caused to be in tight contact with the inner circumferential surface of the insertion hole.

(2) Relationship Between Area Ratio S'/S and Water Stopping Performance

Figure 5:
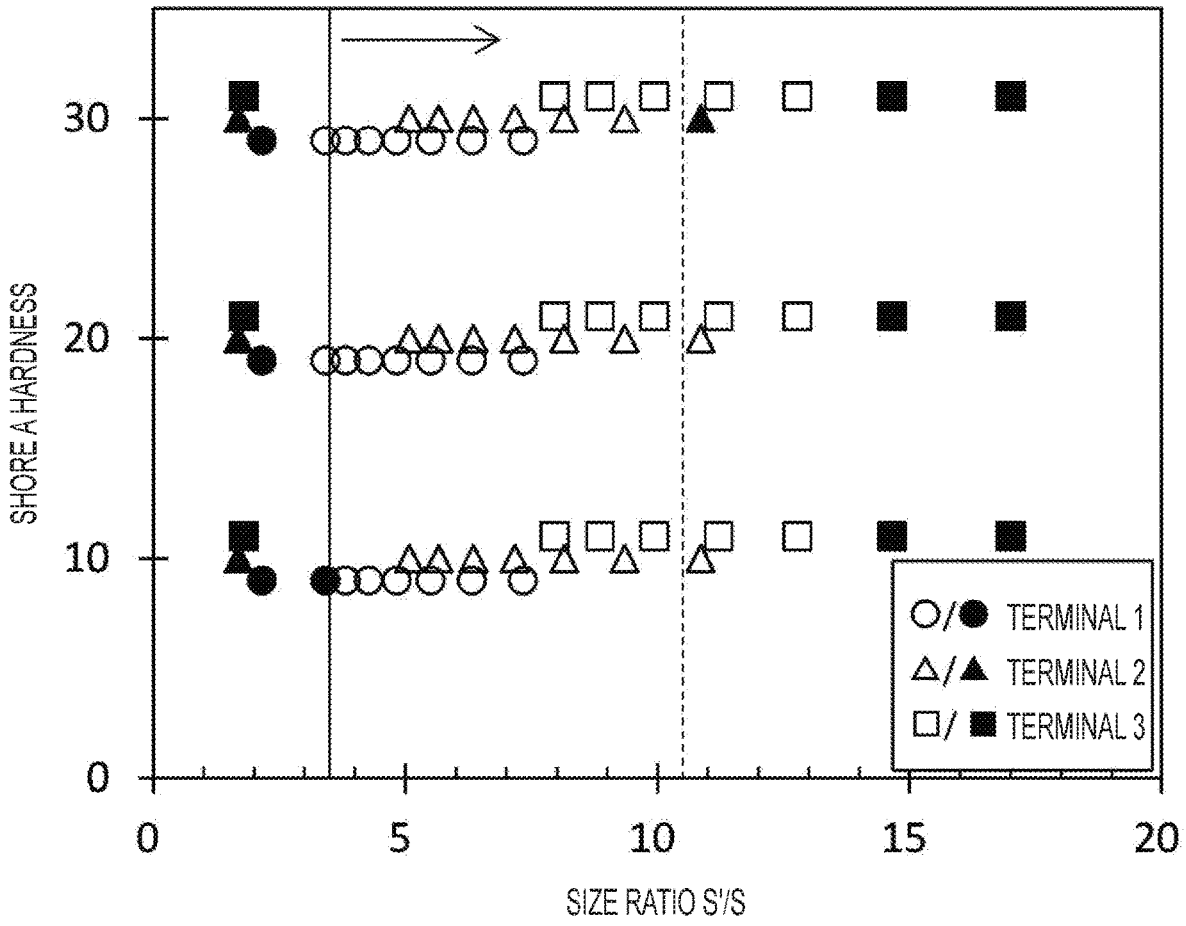
FIG. 5 is a diagram showing the relationship between an area ratio S'/S and water stoppability with regard to examples.

Relationships between the results of evaluation of the area ratio S'/S and water stoppability are shown in FIG. 5. The results are shown in FIG. 5 in a similar manner to that of FIG. 4.

As shown in FIG. 5 using a solid line, it is possible to identify combinations of seal members and terminals that exhibit high water stopping performance as a result of making $S'/S \geq 3.5$ hold true to cause the terminal-equipped electrical wire to be in tight contact with the inner circumferential surface of the insertion hole. Thus, the boundary for preventing the size of a terminal from being excessively small with respect to an insertion hole can be more accurately defined by combining the index of $2.1 \leq L/D \leq 4.2$ with the index of $S'/S \geq 3.5$.

On the other hand, in FIG. 5, it is difficult to provide a boundary for appropriately defining a region where water stoppability is sufficient and a region where water stoppability is insufficient in the region having a large area ratio S'/S. That is, it is difficult to provide the boundary for avoiding the formation of tears from the inner circumferential surface of an insertion hole because the size of a terminal is excessively large with respect to the insertion hole as a result of using the area ratio S'/S as the index. As shown using a broken line in FIG. 5, assuming that, if a boundary for defining a region where water stoppability is sufficient and a region where water stoppability is insufficient is provided, focusing on the case where the terminal 2 was used for the seal member having a Shore A hardness of 30 (triangular marks), many data points (white data points) at which water stoppability was originally sufficient in a case where the Shore A hardness and the terminal type change are categorized into a region where water stoppability is insufficient (a region located on the right side of the broken line). That is, if the area ratio S'/S is used as the index for defining the upper limit of the size of a terminal with respect to an insertion hole, it is not possible to accurately determine whether water stoppability will deteriorate due to tears in a seal member. Thus, it can be said that it is suitable to use, as the index for defining the upper limit of the size of a terminal with respect to an insertion hole, the size ratio L/D, instead of the area ratio S'/S. As shown in Table 2, cross-sections of the terminals 1 to 3 had different aspect ratios, and it is conceivable that tears are likely to form in a seal member when the terminal is inserted into the insertion hole in a case where the aspect ratio greatly deviates from 1 even if the area ratio S'/S is the same, but the area ratio S'/S cannot take such influence of the aspect ratios into consideration. Thus, it is conceivable that the area ratio S'/S is not suitable as the index for determining whether or not water stoppability will deteriorate due to tears in a seal member.

(3) Relationship Between Diameter Ratio ø/D and Water Stopping Performance

Figure 6:
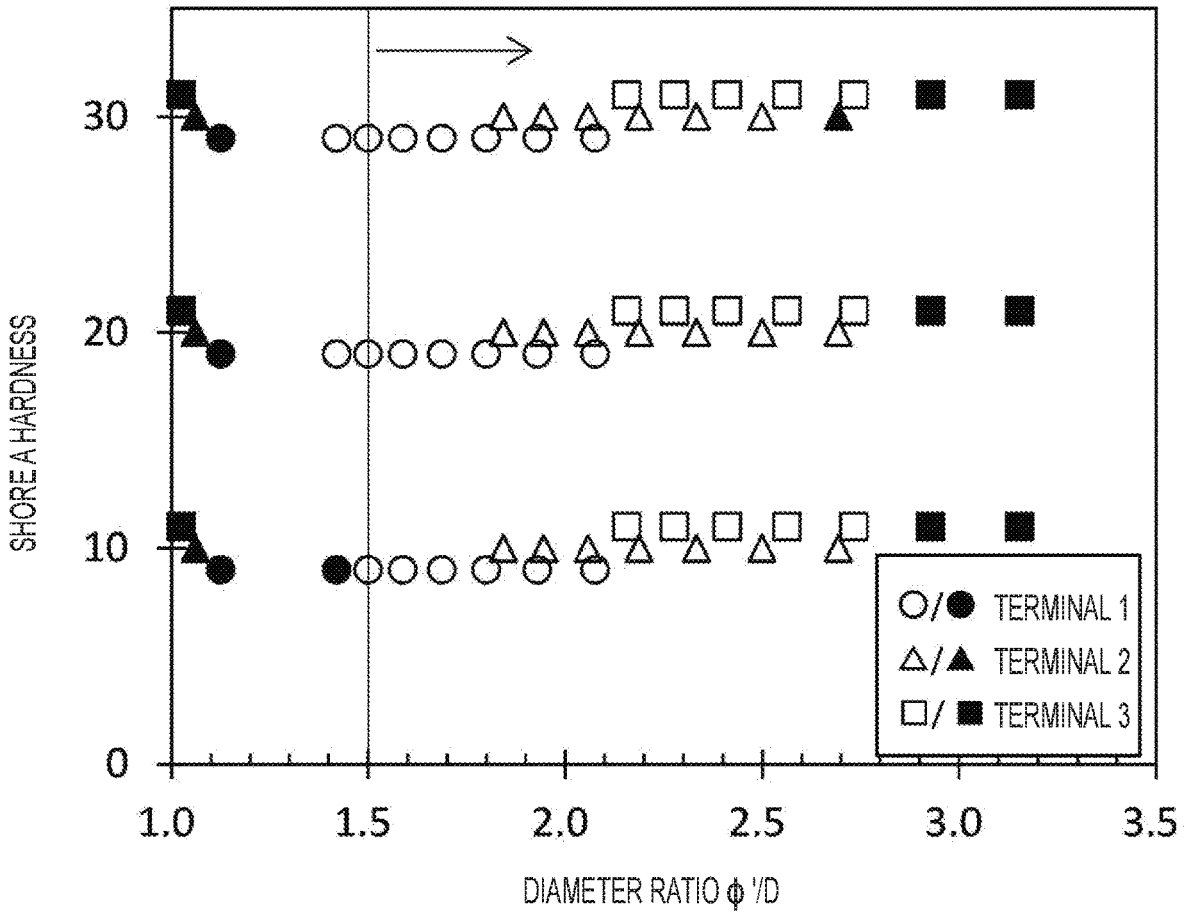
FIG. 6 is a diagram showing the relationship between a diameter ratio ø/D and water stoppability with regard to examples.

Relationships between the results of evaluation of the diameter ratio ø/D and water stoppability are shown in FIG. 6. The results are shown in FIG. 6 in a similar manner to that of FIGS. 4 and 5.

As shown in FIG. 6 using a solid line, it is possible to identify combinations of seal members and terminals that exhibit high water stopping performance as a result of making $ø/D \geq 1.5$ hold true to cause the terminal-equipped electrical wire to be in tight contact with the inner circumferential surface of the insertion hole. Thus, a boundary for preventing the size of a terminal from being excessively small with respect to an insertion hole can be more accurately defined by combining the index of $ø/D \geq 1.5$ with the index of $2.1 \leq L/D \leq 4.2$ or/and the index of $S'/S \geq 3.5$. Note that, because the electrical wire outer diameter of a terminal-equipped electrical wire is smaller than the size of a cross-section of the terminal, whether or not tears will form in an insertion hole of a seal member is unlikely to be affected. Thus, the diameter ratio ø/D cannot be used as the index for defining the boundary for determining whether or not water stoppability will deteriorate due to tears in the seal member in a region having a large diameter ratio.

As shown in Table 1, not only the minimum hole diameter D of an insertion hole but also the adjacent thickness corresponding to the distance between adjacent insertion holes change in each seal member. However, the adjacent thickness does not directly affect water stoppability of the seal member.

Although embodiments of the present disclosure were described above in detail, the present disclosure is not limited to the above-described embodiments, and various modifications can be made without departing from the gist of the present disclosure.

What is claimed is:

1. A seal member comprising:

an insertion hole into which a connector terminal is insertable, wherein a direction in which the connector terminal is to be inserted into the insertion hole is an insertion axis, an inner diameter of a cross-section of the insertion hole orthogonal to the insertion axis at a position at which the inner diameter is the smallest is a minimum hole diameter D, an outer length of a cross-section of the connector terminal orthogonal to the insertion axis at a position at which the outer length is the largest is a maximum terminal outer length L, and the minimum hole diameter D and the maximum terminal outer length L satisfy a relationship $2.1 \leq L/D \leq 4.2$.

2. The seal member according to claim 1, wherein the insertion hole includes a plurality of insertion holes.

3. The seal member according to claim 1, wherein the minimum hole diameter D is a diameter obtained when a cross-section of the insertion hole orthogonal to the insertion axis is approximated to a circle, and the maximum terminal outer length L is a length of a diagonal line obtained when a cross-section of the connector terminal orthogonal to the insertion axis is approximated to a quadrilateral.

4. The seal member according to claim 1, wherein an area of a cross-section of the insertion hole orthogonal to the insertion axis at a position at which the area is the smallest is a minimum hole area S, and an area of a cross-section of the connector terminal orthogonal to the insertion axis at a position at which the area is the largest is a maximum terminal area S', and the minimum hole area S and the maximum terminal area S' satisfy a relationship $S'/S \geq 3.5$.

5. The seal member according claim 1, wherein an outer diameter of an electrical wire to be connected to the connector terminal is an electrical wire diameter ø, the electrical wire diameter ø and the minimum hole diameter D satisfy a relationship $ø/D \geq 1.5$.

6. The seal member according to claim 1, wherein the seal member contains rubber or an elastomer.

7. The seal member according to claim 1, wherein the seal member contains silicone rubber.

8. The seal member according to claim 1, wherein the seal member has a Shore A hardness of 10 to 30 inclusive.

9. A waterproof connector comprising:

the seal member according to claim 1; and the connector terminal, wherein the connector terminal is inserted into the insertion hole of the seal member.

10. The waterproof connector according to claim 9, wherein the connector terminal is connected to a terminal end of an electrical wire, and an inner circumferential surface of the insertion hole of the seal member is in surface contact with the electrical wire.

11. The waterproof connector according to claim 9, further comprising a connector housing, wherein the seal member is housed in the connector housing.

12. The waterproof connector according to claim 11, wherein the seal member is housed in the connector housing in a compressed state.

* * * * *